US006303033B1

(12) United States Patent
Malone et al.

(10) Patent No.: US 6,303,033 B1
(45) Date of Patent: Oct. 16, 2001

(54) RETRIEVABLE FILTER ELEMENT FOR SUBSURFACE DRAINAGE

(75) Inventors: Philip G. Malone, Vicksburg, MS (US); Brad L Huntsman, Dayton; Brent E. Huntsman, Xenia, both of OH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/408,911

(22) Filed: Sep. 30, 1999

(51) Int. Cl.[7] ..... B01D 24/00

(52) U.S. Cl. ..... 210/282; 210/484; 210/489; 210/499; 210/170

(58) Field of Search ..... 210/170, 291, 210/316, 317, 459, 461, 484, 486, 487, 489, 499, 282; 405/44, 45, 48, 50, 157

(56) References Cited

U.S. PATENT DOCUMENTS 4,699,838 * 10/1987 Gilbert ..... 405/157
5,089,108 * 2/1992 Small ..... 210/484
5,100,258 * 3/1992 Van Wagoner ..... 405/45

FOREIGN PATENT DOCUMENTS

403279509 * 12/1991 (JP) .

* cited by examiner

*Primary Examiner*—Matthew O. Savage
(74) *Attorney, Agent, or Firm*—John MacEvoy

(57) ABSTRACT

Filter elements for draining wastewater into the soil in leach fields comprise net sacks filled with scrap rubber or plastic chips and supplied with fabric filter cloth. Leach fields are constructed by excavating trenches, placing a first row of filter elements at the bottom of the trenches, installing a drain pipe on top of the row of filter elements, placing a second row of filter elements on top of the first row and the drain pipe, overlapping the pieces of filter cloth to provide a barrier to the surrounding soil, and backfilling the trench with soil.

11 Claims, 1 Drawing Sheet

RETRIEVABLE FILTER ELEMENT FOR SUBSURFACE DRAINAGE

GOVERNMENT INTEREST STATEMENT

The invention described herein may be manufactured, licensed, and used by or for governmental purposes without the payment of any royalties thereon.

BACKGROUND OF THE INVENTION

1. Field of the Invention

This invention relates to filter elements for leach fields for draining septic tank effluents, rainwater, and treated industrial and municipal wastewater into the ground by means of buried filter elements. It furthermore relates to filter elements utilizing rubber tire or plastic scrap, wastes that are finding a constructive use in the filter elements of this invention instead of taking up valuable space in landfills.

This invention also relates to a process for constructing leach fields utilizing the filter elements of this invention.

2. Prior Art

Septic tank effluents, rainwater, and treated industrial and municipal wastewater are conventionally drained into the soil through slofted or perforated drain pipes into trenches filled with gravel and then backfilled with soil. The gravel facilitates the drainage of water into the soil and delays the plugging of the slots or perforations in the drain pipes by soil particles. However, the slots or perforations in the drain pipes and the gravel beds eventually do become plugged with fine solids leached from the soil, making the leach fields ineffective and requiring the removal of the drain pipes and gravel and the construction of new leach fields.

SUMMARY OF THE INVENTION

The filter elements of this invention are assembled by placing rubber or plastic scrap pieces in net sacks. The rubber and plastic scrap pieces, herein referred to as aggregate, typically, are in the form of chips. Used automobile and truck tires are the principal source of rubber scrap. The net sacks have openings that are smaller than the aggregate chips such that they cannot fall out of the net sacks through these openings when installed. The net sacks containing the aggregate are attached to pieces of fabric filter cloth, which may be wrapped around the net sacks or draped around adjacent filter elements so that the soil surrounding the net sacks cannot infiltrate into the enclosed aggregate chips, but water draining into the aggregate chips can escape through the filter cloth into the surrounding soil. The net sacks filled with the aggregate and wrapped in filter cloth constitute the filter elements of this invention.

In the construction of a leach field, the filter elements are placed in trenches so as completely to surround the perforated or slotted drain pipes that convey the wastewater effluents into the leach field. Every portion of the drain pipes is surrounded by at least two filter elements to ensure that all the wastewater passes through the aggregate The trenches are then backfilled with soil. Fine soil particles cannot enter and plug the filter elements because the pores of the filter cloth are smaller than the soil particles.

This invention also relates to a process for constructing leach fields utilizing the filter elements of this invention.

DETAILED DESCRIPTION OF THE INVENTION

Figure 1:
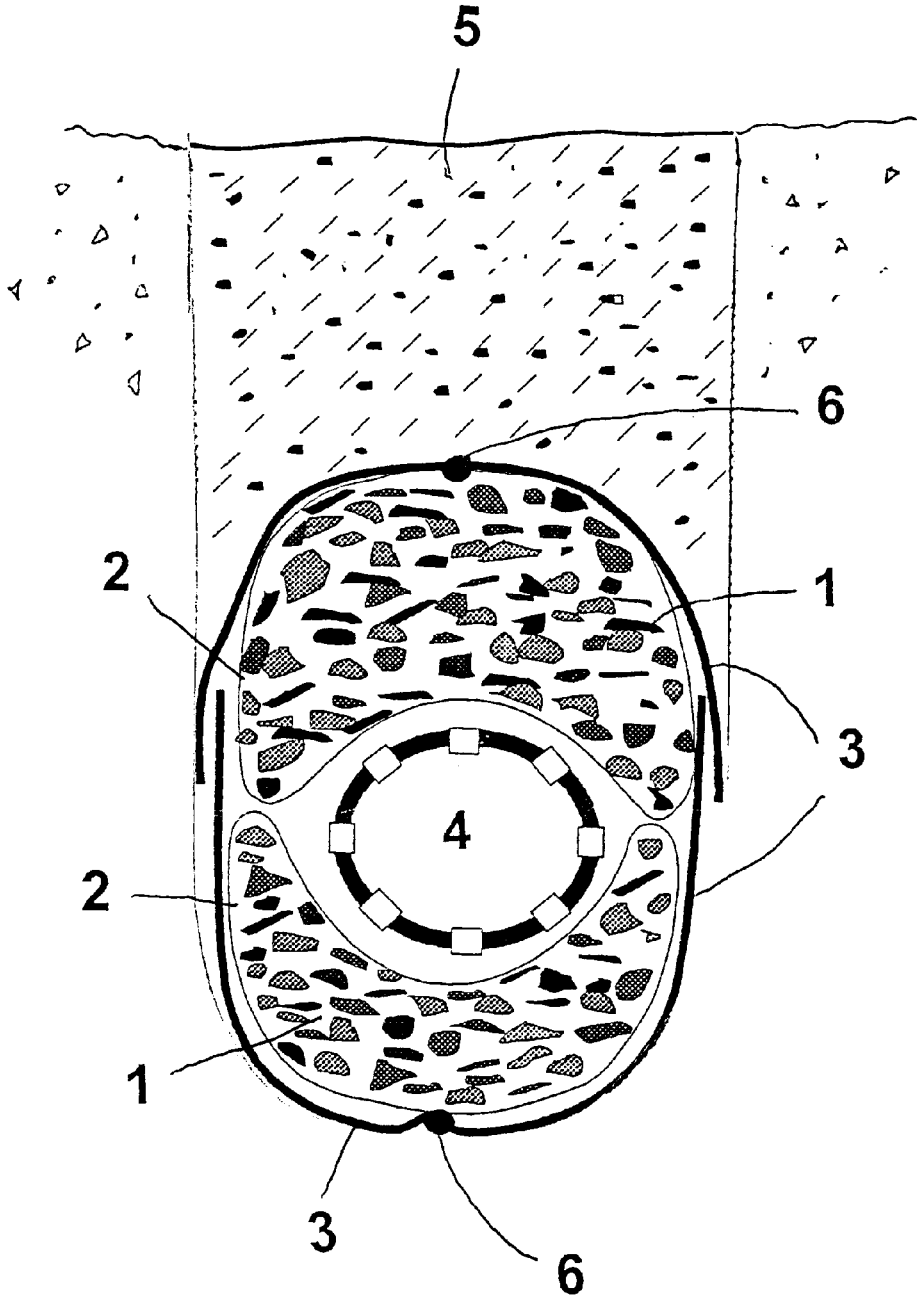
FIG. 1 is a cross-sectional view of the filter elements of this invention as installed in a drainage trench and covered with soil.

With reference to FIG. 1, the filter elements of this invention consist of three parts: aggregate 1, net sacks 2 holding the aggregate, and filter cloth 3. They are assembled by placing rubber or plastic scrap pieces, herein referred to as aggregate 1, in net sacks 2. Used automobile and truck tires are the principal source of rubber scrap. The aggregate pieces, typically, are in the form of chips. The net sacks have openings that are smaller than the aggregate chips such that they cannot fall out of the net sacks through these openings.

The net sacks containing the aggregate preferably are furnished with an attached section of fabric filter cloth. When being installed around the drainage pipe in the trench, the net sacks with aggregate are placed against the perforated pipe, and the filter cloth on each net sack is made to overlap with that of an adjacent element to form a barrier preventing infiltration of fine soil particles into the aggregate. Optionally, the net sacks with aggregate may be wrapped individually with filter cloth. The net sacks filled with the aggregate and wrapped in filter cloth in any manner whatever, constitute the filter elements of this invention.

In the construction of a leach field, the filter elements are placed in trenches so as completely to surround the slotted or perforated drain pipes 4 that convey the wastewater effluents into the leach field. The net sacks are placed directly against the drain pipe and the filter cloth is draped against the surface of the surrounding soil. A row of filter elements is placed on the bottom of each trench, the drain pipe is installed to rest on this row of filter elements, a second row of filter elements is placed on top of the lower row of filter elements and the drain pipe 4, and the trench is backfilled with soil 5. The upper and lower pieces of filter cloth are allowed to drape over one another. Optionally, each net bag with aggregate may be wrapped individually in filter cloth. The object is to create a barrier with the filter cloth preventing fine soil particles from entering and plugging the filter elements because the pores of the filter cloth are smaller than the soil particles.

The rubber scrap pieces are typically in the form of chips about ¾" to 2" long and wide by about ¼" to ¾" thick. Plastic scrap pieces also range from ¾" to 2" in diameter. The openings in the net sacks are about ¼" to ½" across. Aggregate pieces thus cannot fall out through these openings once placed in the net.sacks.

The net sacks filled with aggregate are wrapped in pieces of filter cloth having small pore sizes (<1/16"). These prevent fine soil particles from being washed into the net sacks and plugging the void spaces between the aggregate pieces. The filter fabric may optionally be connected to the net sack at 6 by metal wires, preferably iron wires, which help locate the trenches of the leach fields with metal detectors once they are buried. Also, pieces of brightly colored plastic tape may be attached to the filter elements to help locate the elements when a trench is reopened to service the leach field.

The net sacks preferably have a volume of 2 to 2.5 cubic feet. The bulk density of the aggregate ranges from 25 to 30 lbs. per cubic foot. The weight of a filter element thus ranges from about 50 to about 75 lbs. Filter elements thus may be preassembled at a convenient off-site location, shipped to the jobsite, and installed.

The net sacks and the filter cloths used in the construction of the filter elements of this invention are made of polymeric materials such as polyester (e.g., polyethylene glycol terephthalate), polypropylene, polyethylene, polyamide (e.g., nylon), and polyvinyl chloride. For the net sacks, polyester and nylon are preferred. For the filter cloth, spun-woven or heat-bonded polypropylene is preferred.

While this invention has been described in terms of a specific embodiment, it is understood that it is capable of further modification and adaptation of the invention following in general the principle of the invention and including such departures from the present disclosure as come within the known and customary practice in the art to which the invention pertains and may be applied to the central features set forth, and fall within the scope of the invention and of the limits of the appended claims.

What we claim is:

1. Filter elements for positioning adjacent a perforate drain pipe in a leach field for draining wastewater into the ground, each such filter element comprising:

(a) a net sack having openings of a predetermined size;

(b) aggregate disposed within said net sack and having dimensions greater than the openings of said net sack;

(c) a sheet of filter cloth disposed on said net sack and around portions of said net sack removed from the drain pipe, said sheet having free edges on opposite sides of said net sack for overlapping free edges of an adjacent sheet of filter cloth;

whereby during construction of a leach field, the sheets of filter cloth and the filter elements are adapted to be placed in trenches so as to surround the drain pipe conveying wastewater into the leach field.

2. Filter elements according to claim 1 wherein said aggregate comprises chips from scrap rubber tires.

3. Filter elements according to claim 2 wherein said aggregate chips are provided with widths and lengths from about ¾" to about 2" and thicknesses from about ¼" to about ¾".

4. Filter elements according to claim 1 wherein said aggregate comprises chips of scrap plastic.

5. Filter elements according to claim 4 wherein said aggregate chips are provided with major dimensions ranging from about ¾" to about 2".

6. Filter elements according to claim 1 wherein said net sack openings are from about ¼" to about ½" in diameter.

7. Filter elements according to claim 1 wherein said sheet of filter cloth has pore openings less than about 1/16" in diameter.

8. Filter elements according to claim 1 wherein said sheet of filter cloth is attached to said net sack.

9. Filter elements according to claim 1 wherein net sack is made of a polymeric material selected from the group consisting of polyester, polypropylene, polyethylene, nylon, and polyvinyl chloride.

10. Filter elements according to claim 1 wherein said sheet of filter cloth is made of a polymeric material selected from the group consisting of polyester, polypropylene, polyethylene, nylon, and polyvinyl chloride.

11. Filter elements according to claim 1 wherein said sheets of filter cloth are fastened to said net sacks with iron wire, whereby the filter elements may be detected with metal detectors when buried.

* * * * *